US006422317B1

(12) United States Patent
Williamson, Jr.

(10) Patent No.: US 6,422,317 B1
(45) Date of Patent: Jul. 23, 2002

(54) FLOW CONTROL APPARATUS AND METHOD FOR USE OF THE SAME

(75) Inventor: Jimmie Robert Williamson, Jr., Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 22 days.

(21) Appl. No.: 09/654,675

(22) Filed: Sep. 5, 2000

(51) Int. Cl.[7] ..... E21B 34/10; E21B 34/14

(52) U.S. Cl. ..... 166/374; 166/320; 166/332.4; 166/373; 166/386

(58) Field of Search ..... 166/320, 321, 166/332.4, 373, 374, 375, 386; 251/634, 349

(56) References Cited

U.S. PATENT DOCUMENTS 3,494,419 A * 2/1970 Mullins ..... 166/150
4,134,454 A * 1/1979 Taylor ..... 137/629
4,162,691 A * 7/1979 Perkins ..... 137/613
5,316,084 A * 5/1994 Murray et al. ..... 166/332.4
5,443,124 A * 8/1995 Wood et al. ..... 166/319
5,505,263 A * 4/1996 White et al. ..... 166/122
5,666,050 A 9/1997 Bouldin et al. ..... 324/207.26
5,794,699 A 8/1998 Hammett et al. ..... 166/332.2
5,957,207 A 9/1999 Schnatzmeyer ..... 166/332.1
5,957,208 A 9/1999 Schnatzmeyer ..... 166/373
5,979,558 A * 11/1999 Bouldin et al. ..... 166/334.4

* cited by examiner

*Primary Examiner*—George Suchfield
(74) *Attorney, Agent, or Firm*—William M. Imwalle; Lawrence R. Youst

(57) ABSTRACT

An apparatus (30) and method for regulating fluid flow through a downhole tubing string (28) is disclosed. The apparatus (30) comprises a generally tubular outer housing (32) having a housing port (38) formed through a sidewall portion thereof. First and second seats (78, 68) are disposed within the housing (32), each having sealing surface (82, 76) that are sealingly engageable to one another to substantially prevent fluid flow therebetween. A sleeve (44) is slidably disposed within the first and second seats (68, 78). The sleeve (44) has a flow passage extending generally axially therethrough and is variably positionable relative to the first seat (78) to regulate fluid flow through a sleeve port (46). The sleeve (44) has first and second positions relative to the second seat (68). In the first position, a seal (66) is disposed between the sleeve (44) and the first seat (78), thereby preventing fluid flow through the sleeve port (46). In the second position, the seal (66) is disposed between the sleeve (44) and the second seat (68), thereby not preventing fluid flow through the sleeve port (46).

40 Claims, 9 Drawing Sheets

26
10
12
20
22
18
28
24
32
30
16
34
36
30
14
38

FLOW CONTROL APPARATUS AND METHOD FOR USE OF THE SAME

TECHNICAL FIELD OF THE INVENTION

The present invention relates in general to the field controlling fluid flow in a subterranean well and, more particularly, to a flow control device having redundant sealing capability for regulating fluid flow through a tubing string disposed within a well.

BACKGROUND OF THE INVENTION

With limiting the scope of the present invention, its background will be described with reference to a regulating fluid flow into a wellbore having one or more subsea completions as an example.

In subsea completions, a flow control apparatus, known as a choke, is typically installed in the production tubing string to throttle fluid flow entering the tubing string. The choke is particularly useful where multiple zones are produced into the tubing string and it is desired to regulate the rate of fluid flow from each zone. Additionally, regulatory authorities may require that rates of production from each zone be reported, necessitating the use of the choke or other methods of determining and controlling the rate of production from each zone. Safety concerns may also dictate controlling the rate of production from each zone.

Chokes are also useful in subsea well having single zone completions. For example, in a wellbore producing from a single zone, an operator may determine that it is desirable to reduce the flow rate from that zone to limit damage to the reservoir, reduce water coning or enhance ultimate recovery.

The typical choke that is placed downhole to limit flow from a certain formation into the tubing string has a fixed orifice which cannot be closed. These conventional chokes require intervention to change the size of the fixed orifice. To compensate for changing well conditions or simply to make adjustments in the flowrate therethrough, these chokes typically require slickline, wireline or other operations, which need a rig for their performance.

Attempts have been made to overcome these limitations associated with convention chokes. For example, infinitely variable interval control valves ("IVICV") have been used. These IVICVs are designed not only for operation in fully closed and fully open configurations, but also, in variable positions that allow for the regulation of fluid flow therethrough. Typically, IVICVs utilize a metal-to-metal sealing surface in the fully closed position to prevent fluid flow therethrough. It has been found, however, that the surfaces of the metal-to-metal seal are susceptible to erosion when the IVICV is in an open position, particularly when the IVICV is throttling flow. Once the sealing surfaces have been eroded, the IVICV is no longer capable of fully preventing fluid flow therethrough even when it is in the fully closed position.

Therefore a need has arisen for a flow control apparatus that is rugged, reliable, and capable of withstanding extreme environmental conditions, so that it may be utilized in completions without requiring frequent service, repair or replacement. A need has also arisen for such a flow control apparatus that is capable of accurately regulating fluid flow therethrough and that is resistant to erosion, even when it is configured between its fully open and closed positions. Further, a need has arisen for such a flow control apparatus that is capable fully providing a seal even when erosion of the metallic sealing surfaces has occurred.

SUMMARY OF THE INVENTION

The present invention disclosed herein comprises a flow regulating apparatus that is rugged, reliable and capable of withstanding extreme environmental conditions, so that it may be utilized in completions without requiring frequent service, repair or replacement. The flow regulating apparatus of the present invention is capable of accurately regulating fluid flow therethrough and is resistant to erosion, even when it is configured between its fully open and closed positions. In addition, the flow regulating apparatus of the present invention is capable of fully providing a seal even when erosion of the metallic sealing surfaces has occurred.

The flow regulating apparatus of the present invention comprises a generally tubular outer housing having a housing port formed through a sidewall portion thereof. First and second seats are disposed within the housing. The first seat is substantially fixed relative to the housing. The second seat is slidable relative to the housing. In operation, the second seat is movable relative to the first seat such that a sealing surface of the first seat and a sealing surface of the second seat may be sealingly engaged together, forming a metal-to-metal seal, to substantially prevent fluid flow therebetween. In addition, the first and second seats may be separated from one another to permit fluid flow therebetween.

The flow regulating apparatus of the present invention also comprises a sleeve that is slidably disposed within the first and second seats. The sleeve has a flow passage extending generally axially therethrough and has a sleeve port formed through a sidewall portion thereof. The sleeve is variably positionable relative to the first seat to regulate fluid flow through the sleeve port. The sleeve has a seal disposed thereon that selectively provide a redundant seal for the flow regulating apparatus of the present invention. Specifically, the seal, which may be an elastomeric seal, may be positioned between the sleeve and the first seat. In this position, the seal provides redundant sealing capability in addition to the metal-to-metal seal between the first and second seats, thereby fully preventing fluid flow between the housing port and the sleeve port of the flow regulating apparatus of the present invention.

The sleeve may be slidable repositioned relative to the first and second seats to remove the redundant sealing capability. In this position, the seal is disposed between the sleeve and the second seat. As such, the seal no longer prevents fluid flow between the housing port and the sleeve port leaving only the metal-to-metal seal to prevent fluid flow between the housing port and the sleeve port. While the metal-to-metal seal may be sufficient in some application for some period of time, typical metal-to-metal seals are susceptible to leakage, particularly if the sealing surfaces are subject to erosion. The flow regulating apparatus of the present invention, however, overcomes this limitation through the use of the redundant sealing capability provided by the seal when it is disposed between the sleeve and the first seat.

In addition, the seal of the flow regulating apparatus of the present invention is not subject to the hostile environment typically encountered in conventional choke applications. Specifically, the seal is not subject to abrasive wear or erosion either when providing or not providing the redundant seal. More specifically, the sealing surfaces of the first and second seats remain engaged during redundant sealing operations and during movement of the sleeve relative to the second seat which moves the seal out of redundant sealing operations. As such, the seal is never required to seal against high velocity fluid flow and suffer the associated degradation.

To regulate the fluid flow through the flow regulating apparatus of the present invention, the sleeve and the second seat are slidably repositionable relative to the first seat. As the sleeve continues to move in the direction that removed the redundant seal, the sleeve and the second seat begin to move together to disengage the seal between the sealing surfaces of the first and second seats. As the sleeve continues movement in this direction, the sleeve port becomes aligned with the end of the first seat such that fluid flow through the sleeve port may occur. The volume of fluid flow may now be infinitely regulated by adjusting the amount of obstruction provided by the first seat relative to the sleeve port. Continued movement of the sleeve in the original direction eventually allows unregulated fluid flow through the sleeve port when the flow regulating apparatus of the present invention is in its fully open position.

Reversing the direction of movement of the sleeve may return the flow regulating apparatus of the present invention to its fully closed position. This is achieved by first increasing the level of obstruction of the first seat relative to the sleeve port until it is fully obstructed and bringing the sealing surfaces of the first and second seats into sealing engagement with one another. Once substantially all of the fluid flow is restricted by the sealing engagement of the first and second seats, the sleeve continues its travel in this direction relative to both the first and second seats such that the seal may slide across the sealing engagement of the sealing surfaces of the first and second seats to fully seal the flow regulating apparatus of the present invention.

In one embodiment of the present invention, the movement of the sleeve relative to the first and second seats and the movement of the sleeve and second seat relative to the first seat may be achieved using mechanical means such as via wireline or slickline. In another embodiment of the present invention, the movement of the sleeve relative to the first and second seats and the movement of the sleeve and second seat relative to the first seat may be achieved using hydraulic fluid pressure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not define the scope of the invention.

Figure 1:
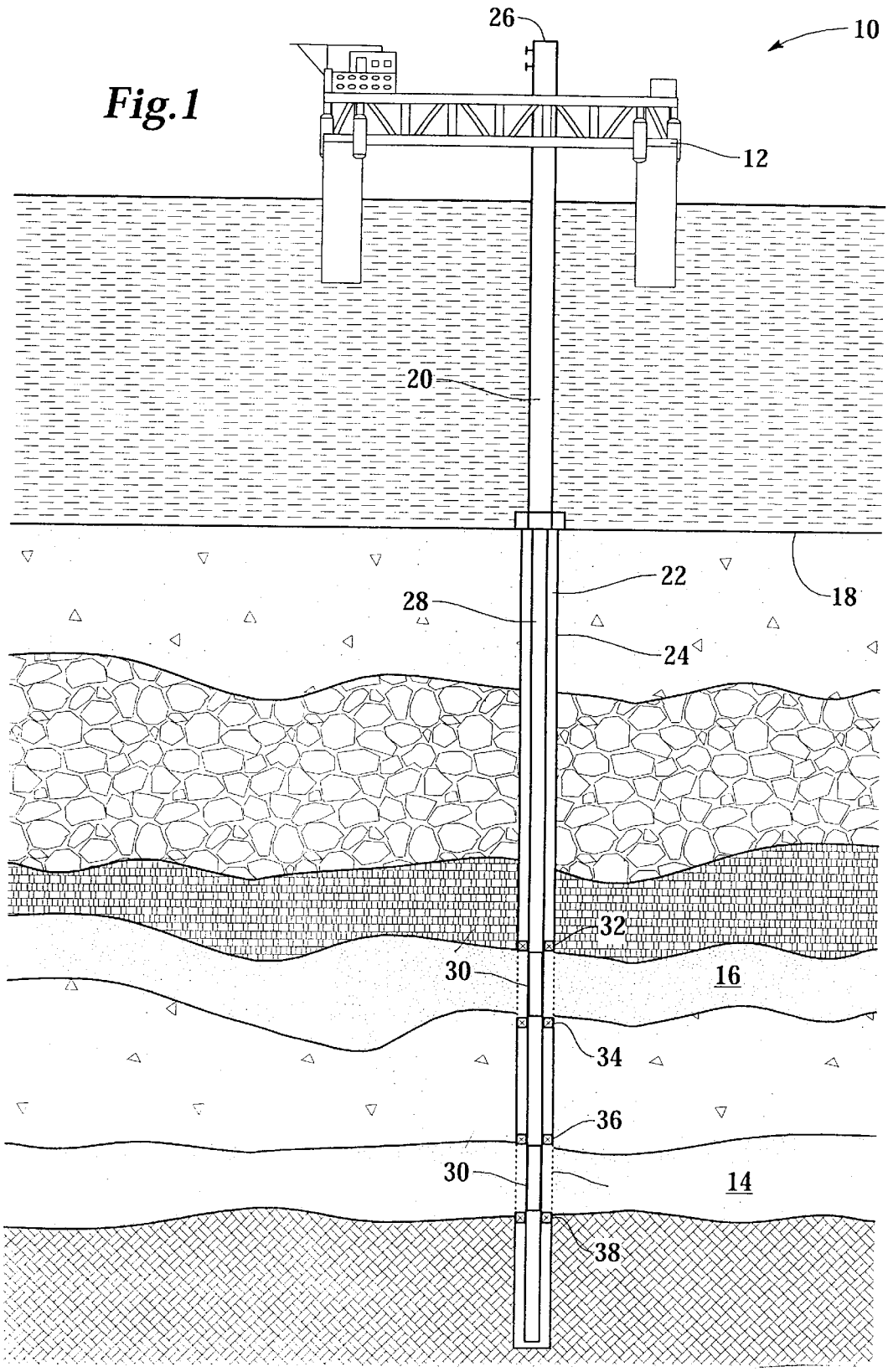
FIG. 1 is a schematic illustration of an offshore oil or gas production platform operating a pair of flow control devices of the present invention.

Referring to FIG. 1, a pair of flow regulating devices in use with an offshore oil and gas production platform is schematically illustrated and generally designated 10. Semi-submersible platform 12 is centered over submerged oil and gas formations 14, 16 located below sea floor 18. A well 20 extends from platform 12 through the sea and penetrates the various earth strata including formations 14, 16 forming, wellbore 22. A casing string 24 extends from wellhead 26 into wellbore 22 and is cemented in place. Also extending from wellhead 26 is a tubing string 28. Well 20 is completed in formations 14, 16 such that hydrocarbon fluids may be produced into tubing sting 28. Incorporated into tubing string 28 is a pair of flow regulating devices 30. One flow regulating device 30 is associated with the completion of formation 16 including seal assemblies 32, 34 while the other flow regulating device 30 is associated with the completion of formation 14 including seal assemblies 36, 38. As will be discussed in more detail below, flow regulating devices 30 allow the operator of platform 12 to regulate the fluid flow from formation 14, 16. For example, by operating flow regulating devices 30, the operator may produce from formation 14 while shutting in production from formation 16. When it is desirable to stop producing from formation 14, the operator may shut in production from formation 14 and produce from formation 16. Alternatively, both flow regulating devices 30 may be fully or partially opened such that fluids may be produced from both formations 14, 16. In fact, using flow regulating devices 30, the operator may determine the individual production rates from formations 14, 16.

Figure 2A:
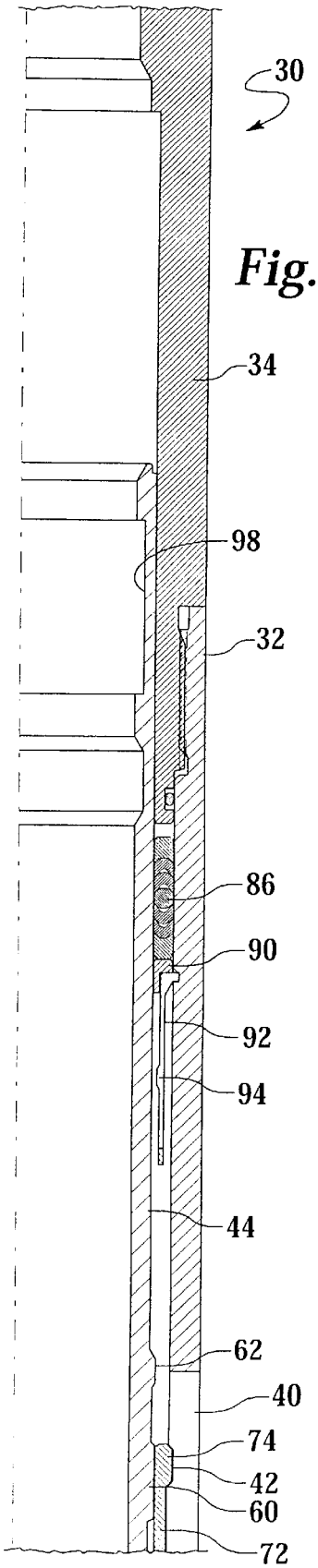
FIGS. 2A–2B are quarter sectional views of seccessive axial sections of a flow control device of the present invention depicted in its fully closed and fully sealed position.
Figure 2B:
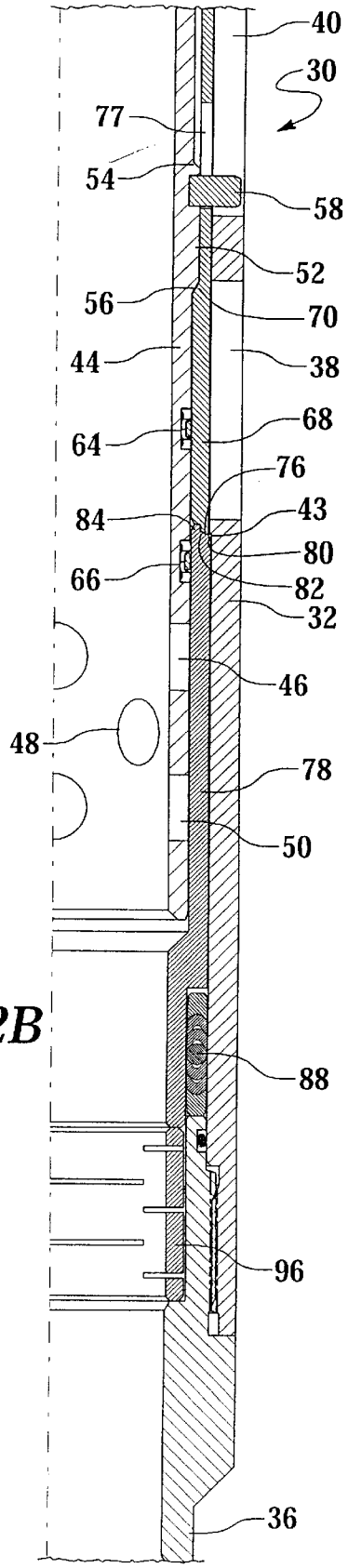

Representatively illustrated in FIGS. 2A–2B is a flow regulating device 30 which embodies principles of the present invention. In the following description of flow regulating device 30 it should be noted that directional terms, such as "above," "below," "upper," "lower," etc., are used for convenience in referring to the accompanying drawings as it is to be understood that the various embodiments of the present invention described herein may be utilized in various orientations, such as inclined, inverted, horizontal, vertical, etc., without departing from the principles of the present invention. Additionally, although flow regulating device 30, shown in the accompanying drawings, is depicted in successive axial sections, it is to be understood that the sections form a continuous assembly.

Flow regulating device 30 has an axially extending generally tubular outer housing 32. Housing 32 is threadedly and sealingly attached to the lower end of an upper connector 34 that coupled to a section of tubing string 28 on the upper end thereof. Housing 32 is threadedly and sealingly attached to the upper end of a lower connector 36 that coupled to a section of tubing string 28 on the lower end thereof.

Housing 32 includes a series of spaced apart openings 38, only one of which is shown, that are circumferentially distributed about housing 32. Openings 38 are formed through housing 32 and thereby provide fluid communication between the area external to flow control device 30 and the interior of housing 32. Housing 32 also includes a series of spaced apart slots 40, only one of which is shown, that are circumferentially distributed about housing 32. Housing 32 has a radially reduced interior region 42, thereby forming upper and lower internal shoulders above and below the region 42. Housing 32 also has a lower shoulder 43.

Flow regulating device 30 has an axially extending generally tubular inner sleeve 44. Sleeve 44 is substantially disposed within housing 32 and axially moveable relative to housing 32. Sleeve 44 includes a series of axially spaced apart openings 46, 48, 50, that are circumferentially distributed about sleeve 44. Openings 46, 48, 50 are formed through sleeve 44 and thereby provide fluid communication between the area internal to flow control device 30 and the exterior of sleeve 44. Sleeve 44 has a radially extended exterior region 52, thereby forming upper and lower external shoulders 54, 56, respectively, above and below region 52. A series of radially outwardly extending lugs 58 extends from region 52 and travel within slots 40 of housing 32 to define the limits of relative axial movement between sleeve 44 and housing 32 as will be described in greater detail below. Sleeve 44 has a radially extended exterior region 60, thereby forming upper and lower external shoulders above and below region 60. In addition, sleeve 44 has a radially extended exterior region 62, thereby forming upper and lower external shoulders above and below region 62.

Sleeve 44 carries an upper seal element 64 and a lower seal element 66. In the illustrated embodiment, seal elements 64, 66 include an elastomeric ring that is held in place with a metal sleeve. It should be understood, however, by those skilled in the art that seal elements 64, 66 may be selected from a variety of sealing members that are common in the art. For example, seal elements 64, 66 may be spring loaded lip seals or simple O-ring seals. Likewise, seal elements 64, 66 may be elastomeric seals or may alternatively be non-elastomeric seals.

Flow regulating device 30 has an axially extending generally tubular upper seat 68. Seat 68 is disposed between sleeve 44 and housing 32. Seat 68 is axially moveable relative to sleeve 44. Likewise, seat 68 is axially moveable relative to housing 32. Seat 68 includes an upper shoulder 70. Seat 68 also includes a collet section having a plurality of circumferentially distributed collet fingers representatively illustrated by collet finger 72. Collet finger 72 has an upper end that terminates as collet finger head 74. Seat 68 includes a lower sealing surface 76. Seat 68 also includes a series of slots circumferentially distributed around seat 68 and representatively illustrated by slot 77. Each slot 77 receives one of the lugs 58 radially outwardly extending from region 52 of sleeve 44 to define the limits of relative axial movement between sleeve 44 and seat 68 as will be described in greater detail below.

Flow regulating device 30 has an axially extending generally tubular lower seat 78. Seat 78 is disposed between sleeve 44 and housing 32. Seat 78 is substantially fixably positioned relative to housing 32 due to the interaction between upper shoulder 80 of seat 78 and lower shoulder 43 of housing 32. Seat 78 is axially moveable relative to sleeve 44. Seat 78 includes an upper sealing surface 82 and an axially extending and internally inclined lip 84.

Lip 84 acts to prevent, or at least greatly reduce, erosion of sealing surface 82 as well as erosion of sleeve 44. Sealing surface 82 of seat 78 is cooperatively shaped to sealingly engage sealing surface 76 of seat 68, and, in the configuration of flow regulating device 30 shown in FIGS. 2A–2B, sealing surface 82 is contacting and sealingly engaging sealing surface 76. Preferably, sealing surfaces 76, 82 are formed of hardened metal or carbide for erosion resistance, although other materials, such as elastomers, resilient materials, etc., may be utilized without departing from the principles of the present invention.

As such, seat 68 and seat 78 form a trim set. As used herein, the term "trim set" describes an element or combination of elements which perform a function of regulating fluid flow. For example, a Master Flo Flow Trim manufactured by, and available from, Master Flo of Ontario, Canada may be used to perform this function, although other trim sets may be utilized without departing from the principles of the present invention.

Flow regulating device 30 has a packing stack 86 that is disposed between sleeve 44 and housing 32. Flow regulating device 30 also has packing stack 88 that is disposed between seat 78 and housing 32. Supporting packing stack 86 within flow regulating device 30 is a bearing ring 90. An axially extending generally tubular collet extends downwardly from bearing ring 90. The collet has a plurality of circumferentially distributed collet fingers representatively illustrated by collet finger 92. Each collet finger has a radially extended interior region that is representatively illustrated as region 94 on collet finger 92. Flow regulating device 30 has an axially extending generally tubular biasing device 96 that is axially disposed between lower connector 36 and seat 78 to bias seat 78 toward seat 68.

In operation, flow regulating device 30 has four principal operating configurations. Specifically, flow regulating device 30 has a fully closed, fully sealed configuration, a fully closed, unsealed configuration, a partially opened configuration and a fully open configuration. Referring to FIGS. 2A–2B, flow regulating device 30 is representatively illustrated in a fully closed, fully sealed configuration in which sealing surface 76 of seat 68 is in sealing engagement with sealing surface 82 of seat 80 and seal elements 64, 66 straddle the location of the sealing engagement. Fluid is, thus, prevented from flowing through openings 46, 48, 50.

Figure 3A:
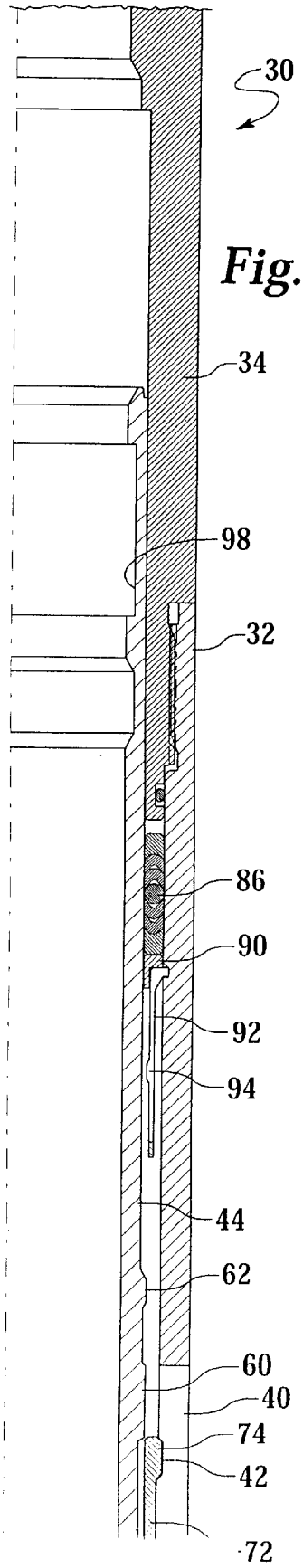
FIGS. 3A–3B are quarter sectional views of seccessive axial sections of a flow control device of the present invention depicted in its fully closed and unsealed position.
Figure 3B:
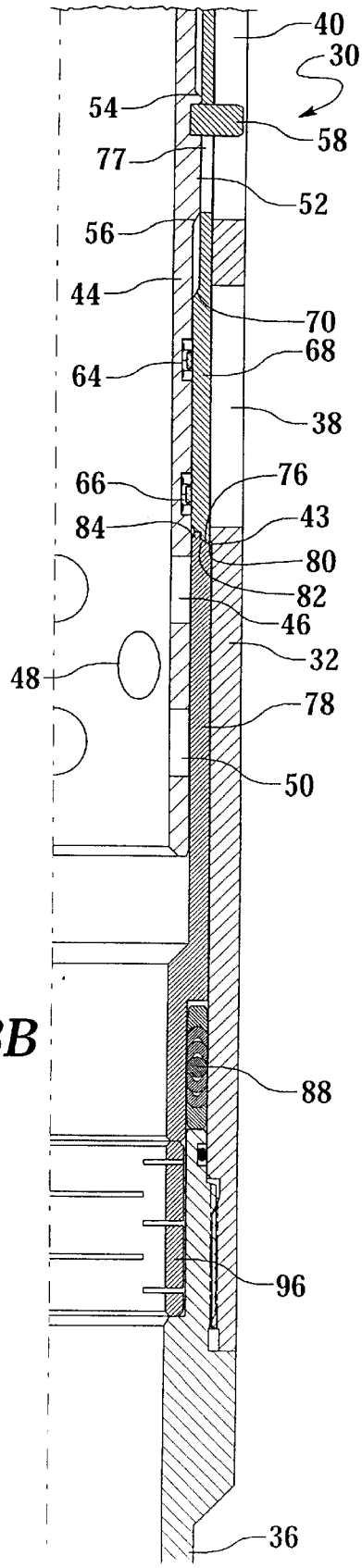

Referring next to FIGS. 3A–3B, flow regulating device 30 is representatively illustrated in a fully closed, unsealed configuration in which sealing surface 76 of seat 68 is in sealing engagement with sealing surface 82 of seat 80 but seal elements 64, 66 no longer straddle the location of the sealing engagement. In the illustrated embodiment, a shifting tool engages shifting profile 98 of sleeve 44 to upwardly shift sleeve 44 relative to seat 68, seat 78 and housing 32. In this configuration of flow control device 30, the sealing engagement of sealing surface 76 of seat 68 with sealing surface 82 of seat 80 substantially prevents fluid flow through openings 46, 48, 50. It is to be understood, however, that it is not necessary and somewhat unlikely that the sealing engagement of sealing surface 76 of seat 68 with sealing surface 82 of seat 80 completely prevents fluid communication between the area external to flow regulating device 30 and the flow passageway within flow regulating device 30 through openings 46, 48, 50.

As can be seen in comparing the configuration of flow regulating device 30 in FIGS. 2A–2B with the configuration of flow regulating device 30 in FIGS. 3A–3B, as sleeve 44 upwardly shifts relative to seat 68, seat 78 and housing 32, lug 58 travels upwardly within slot 40 of housing 32. In addition, lug 58 travels upwardly within slot 77 of seat 68. Also, as best seen in FIGS. 3A–3B, when lug 58 reaches its point of maximum upward travel within slot 77, thus defining the maximum upward travel of sleeve 44 relative to seat 68, the lower shoulder of radially extended exterior region 60 is nearing the top of collet finger head 74. Once radially extended exterior region 60 clears the top of collet finger head 74, collet finger head 74 may radially inwardly shift out of radially reduced interior region 42 of housing 32. Further upward travel of sleeve 44 will thereafter carry seat 68 upwardly due to the contact between lug 58 and the top of slot 77.

Figure 4A:
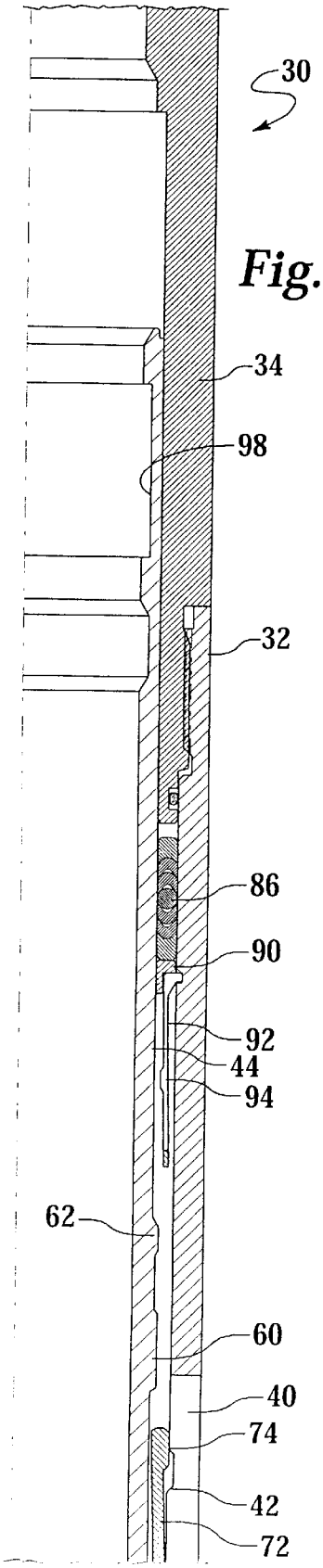
FIGS. 4A–4B are quarter sectional views of seccessive axial sections of a flow control device of the present invention depicted in its partially opened position.
Figure 4B:
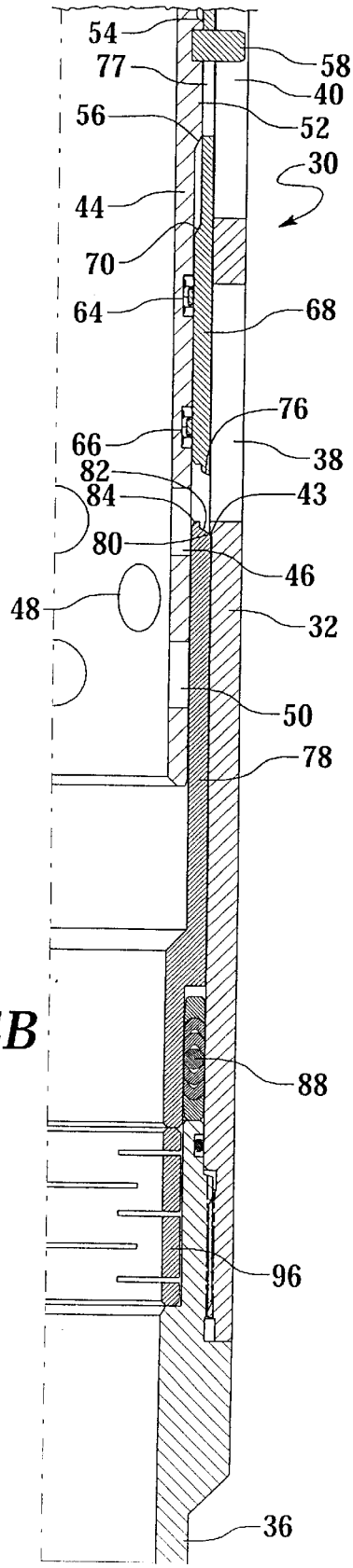

Referring additionally now to FIGS. 4A–4B, flow regulating device 30 is representatively illustrated in a partially open configuration in which the upper openings 46 are partially exposed to direct fluid flow between the exterior of flow regulating device 30 and the fluid passage within flow regulating device 30 through openings 38 of housing 32. In this configuration, the shifting tool has shifted sleeve 44 and seat 68 relative to seat 78 and housing 32, thus permitting fluid flow through the exposed portion of openings 46 of sleeve 44. It should be noted that, as representatively illustrated in the accompanying drawings, openings 46 of sleeve 44 are small compared to openings 38 of housing 32, in order to provide an initial relatively highly restricted fluid flow therethrough when seat 68 is displaced axially away from seat 78. As such, the flowrate of fluid through flow regulating device 30 may be precisely controlled by increasing or decreasing the separation between seat 68 and seat 78.

It should also be noted that while openings 46 are shown identically dimensioned and positioned axially spaced apart, it is to be understood that opening 46 may be otherwise dimensioned, otherwise positioned, otherwise dimensioned with respect to each other, and otherwise positioned with respect to each other, without departing from the principles of the present invention. Additionally, while openings 46 are shown identically dimensioned as openings 48, 50, openings 46 may alternatively have larger or smaller ports, or may have a different orientation with respect to openings 48, 50. Thus, openings 46, 48, 50 shown in the accompanying drawings are merely illustrative and additions, modifications, deletions, substitutions, etc., may be made thereto without departing from the principles of the present invention.

Figure 5A:
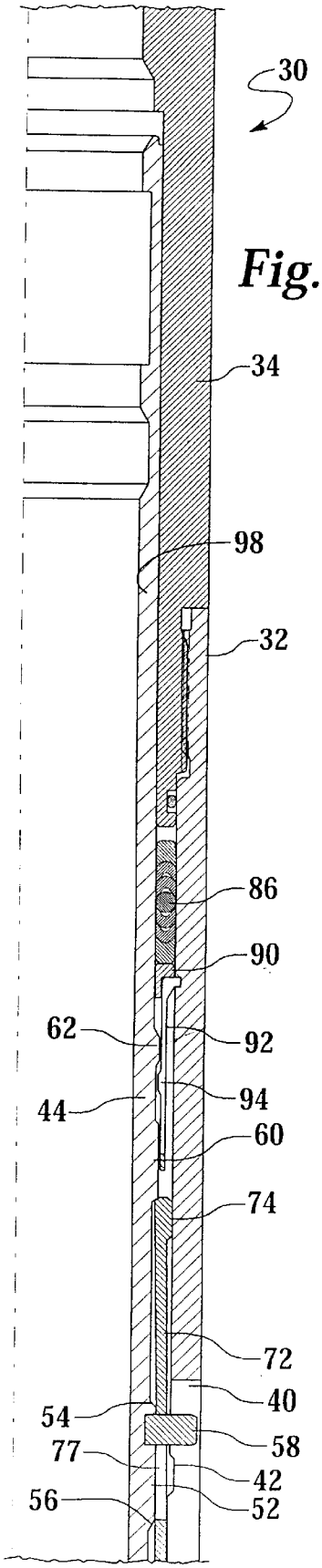
FIGS. 5A–5B are quarter sectional views of seccessive axial sections of a flow control device of the present invention depicted in its fully opened position.
Figure 5B:
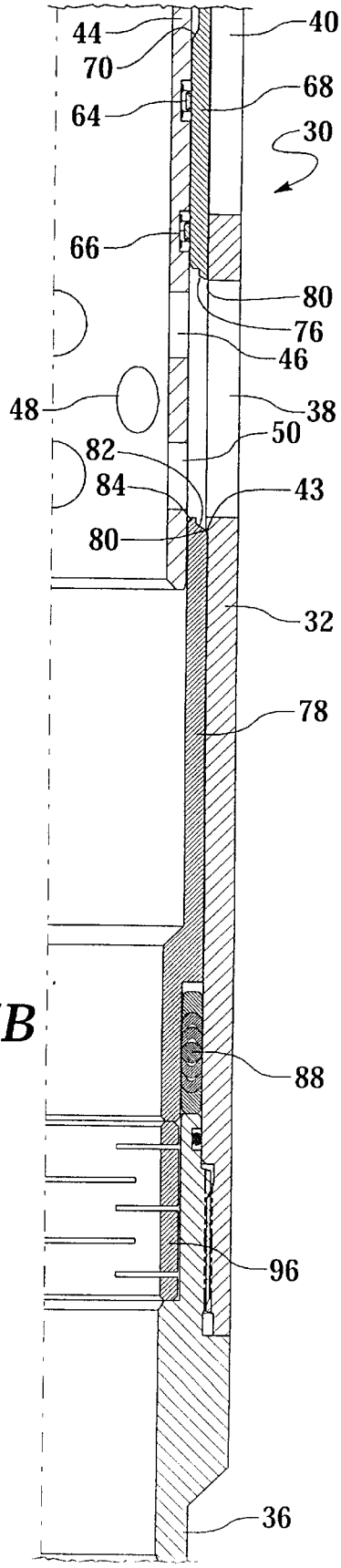

Referring now to FIGS. 5A–5B, flow regulating device 30 is representatively illustrated in a fully open configuration in which seat 78 has completely uncovered openings 46, 48, 50. Fluid is, thus, permitted to flow unobstructed through openings 46, 48, 50 and into the fluid passage of flow regulating device 30. In this configuration, radially extended exterior region 62 of sleeve 44 has moved across radially extended interior region 94 of collet finger 92 which, along with fiction, helps to prevent downward movement of sleeve 44 relative to housing 32 until such downward movement is desired.

To return flow regulating device 30 to one of the prior configurations, the shifting tool engages shifting profile 98 of sleeve 44 to downwardly shift sleeve 44 and seat 68 relative to seat 78 and housing 32. Initially, sleeve 44 and seat 68 move together as the lower shoulder of radially extended exterior region 60 of sleeve 44 acts on the upper surface of collet finger head 74. Seat 68 travels downwardly until sealing surface 76 contacts sealing surface 82 and collet finger head 74 reaches radially reduced interior region 42. Further downward shifting of sleeve 44 results in relative movement between sleeve 44 and seat 68 as lugs 58 slide within slots 77. Such downward relative movement may continue until shoulder 56 contacts shoulder 70. Thereafter, further downward movement of sleeve 44 downwardly urges seat 78 which is upwardly biased by biasing device 96 to increase the force between sealing surfaces 76, 82 to thereby improve their sealing capability.

It should be noted that a particular benefit of this embodiment of the present invention is that portions thereof may erode during normal use, without affecting the ability of flow regulating device 30 to be fully closed and fully sealed to fluid flow therethrough. For example, openings 38, lip 84, opening 46, 48, 50, etc., may erode without damaging sealing surfaces 76, 82 and without damaging seal elements 64, 66. In fact, even if sealing surfaces 76, 82 were eroded, seal elements 64, 66 are never required to seal against high velocity fluid flow and suffer the associated degradation. Thus, where it is important for safety purposes to ensure the fluid tight sealing integrity of the wellbore, flow regulating device 30 preserves its ability to shut off fluid flow therethrough even after its fluid choking elements and its sealing surfaces 76, 82 have been degraded as seal elements 64, 66 are isolated from the flow paths.

It should also be noted that fluids entering flow regulating device 30 from below lower connector 63 may be commingled with fluids entering flow regulating device 30 through openings 46, 48, 50, and the rate of flow of each may be accurately regulated utilizing one or more of the flow regulating devices 30 of the present invention. For example, as seen in FIG. 1, multiple the flow regulating devices 30, may be installed within wellbore 22 to regulate the rate of flow of the fluids therein. Alternatively, a flow regulating device 30 may be used in an injection operation to regulate the rate of fluid flow outward through opening 46, 48, 50 and, alone or in combination with additional flow regulating devices 30, may be utilized to accurately regulate fluid flow rates into multiple zones of well 20. Of course, flow regulating devices 30 may be useful in single zone completions to regulate fluid flow into or out of the zone.

Even though FIGS. 2A–2B, 3A–3B, 4A–4B and 5A–5B, have depicted flow regulating device 30 as being mechanically actuated, it should be understood by those skilled in the art that flow regulating device 30 of the present invention may be otherwise actuated without departing from the principles of the present invention. For example, flow regulating device 30 may be actuated electrically, magnetically, hydraulically or the like.

Figure 6A:
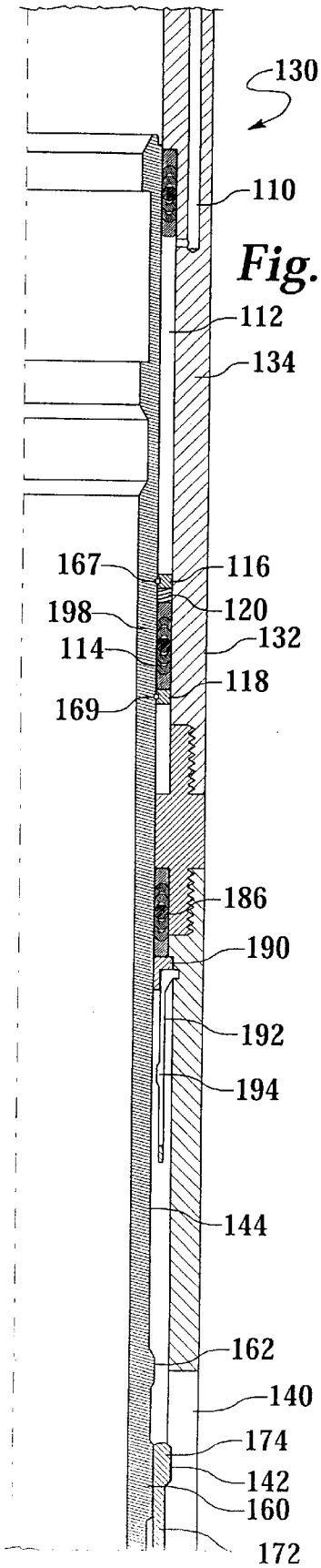
FIGS. 6A–6B are quarter sectional views of seccessive axial sections of a flow control device of the present invention depicted in its fully closed and fully sealed position.
Figure 6B:
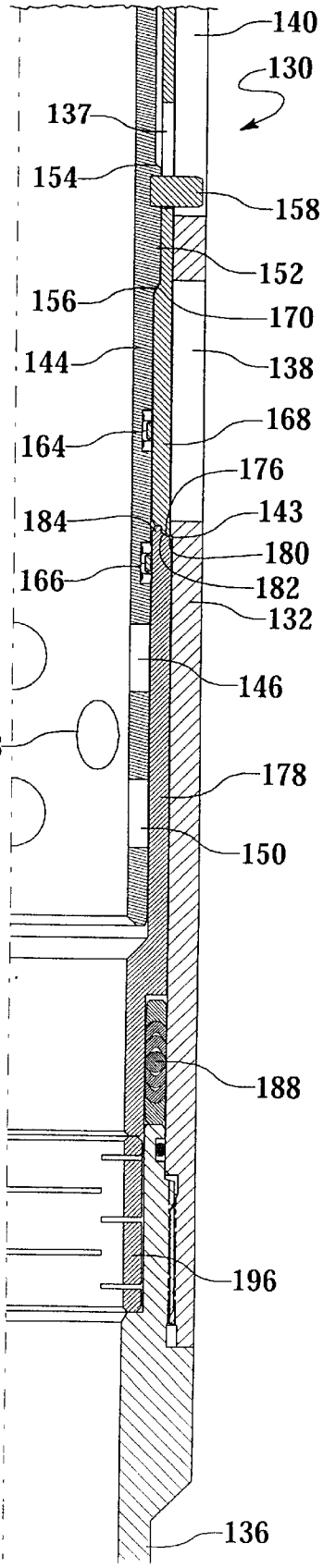

In fact, a hydraulically operated flow regulating device 130 is representatively illustrated in FIGS. 6A–6B. Flow regulating device 130 has an axially extending generally tubular outer housing 132. Housing 132 is threadedly and sealingly attached to the lower end of an upper connector 134 that coupled to a section of tubing string 28 on the upper end thereof. Housing 132 is threadedly and sealingly attached to the upper end of a lower connector 136 that coupled to a section of tubing string 28 on the lower end thereof.

Figure 7A:
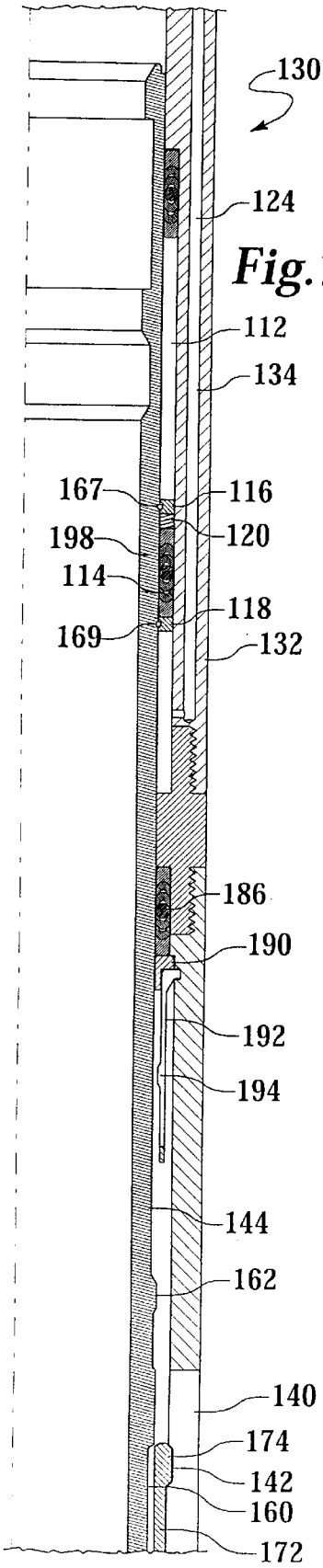
FIGS. 7A–7B are quarter sectional views of seccessive axial sections of a flow control device of the present invention depicted in its fully closed and unsealed position.

An axially extending hydraulic communication port 110 extends through upper connector 134. Hydraulic communication port 110 is attached to a hydraulic line (not pictured) that may extend to platform 12. Hydraulic communication port 110 is in fluid communication with the upper end of a hydraulic chamber 112. Disposed within hydraulic chamber 112 is a packing stack 114 having rings 116, 118 located on either side thereof. Also disposed within hydraulic chamber 112 is a magnetic position sensor 120 that allows for precise locating of the position of sleeve 144 relative to housing 132. As best seen in FIG. 7A, a second axially extending hydraulic communication port 124 extends through upper connector 134 and is attached to a second hydraulic line (not pictured). Hydraulic communication port 124 is in fluid communication with the lower end of hydraulic chamber 112.

Housing 132 includes a series of spaced apart openings 138, only one of which is shown, that are circumferentially distributed about housing 132. Openings 138 are formed through housing 132 and thereby provide fluid communication between the area external to flow control device 130 and the interior of housing 132. Housing 132 also includes a series of spaced apart slots 140, only one of which is shown, that are circumferentially distributed about housing 132. Housing 132 has a radially reduced interior region 142, thereby forming upper and lower internal shoulders above and below the region 142. Housing 132 also has a lower shoulder 143.

Flow regulating device 130 has an axially extending generally tubular inner sleeve 144. Sleeve 144 is substantially disposed within housing 132 and axially moveable relative to housing 132. Sleeve 144 includes a series of axially spaced apart openings 146, 148, 150, that are circumferentially distributed about sleeve 144. Openings 146, 148, 150 are formed through sleeve 144 and thereby provide fluid communication between the area internal to flow control device 130 and the exterior of sleeve 144. Sleeve 144 has a radially extended exterior region 152, thereby forming upper and lower external shoulders 154, 156, respectively, above and below region 152. A series of radially outwardly extending lugs 158, only one of which is shown, extends from region 152 and travel within slots 140 of housing 144 to define the limits of relative axial movement between sleeve 144 and housing 132 as will be described in greater detail below. Sleeve 144 has a radially extended exterior region 160, thereby forming upper and lower external shoulders above and below region 160. In addition, sleeve 144 has a radially extended exterior region 162, thereby forming upper and lower external shoulders above and below region 162. Sleeve 144 includes a pair of radially reduces exterior regions 167, 169 that respective receive portions of ring 116 and ring 118, thereby coupling ring 116 and ring 118 to sleeve 144.

Sleeve 144 carries an upper seal element 164 and a lower seal element 166. In the illustrated embodiment, seal elements 164, 166 include an elastomeric ring that is held in place with a metal sleeve. It should be understood, however, by those skilled in the art that seal elements 164, 166 may be selected from a variety of sealing members that are common in the art. For example, seal elements 164, 166 may be spring loaded lip seals or simple O-ring seals. Likewise, seal elements 164, 166 may be elastomeric seals or may alternatively be non-elastomeric seals.

Flow regulating device 130 has an axially extending generally tubular upper seat 168. Seat 168 is disposed between sleeve 144 and housing 132. Seat 168 is axially moveable relative to sleeve 144. Likewise, seat 168 is axially moveable relative to housing 132. Seat 168 includes an upper shoulder 170. Seat 168 also includes a collet section having a plurality of circumferentially distributed collet fingers representatively illustrated by collet finger 172. Collet finger 172 has an upper end that terminates as collet finger head 174. Seat 168 includes a lower sealing surface 176. Seat 168 also includes a series of slots circumferentially distributed around seat 168 and representatively illustrated by slot 177. Each slot 177 receives one of the lugs 158 radially outwardly extending from region 152 of sleeve 144 to define the limits of relative axial movement between sleeve 144 and seat 168 as will be described in greater detail below.

Flow regulating device 130 has an axially extending generally tubular lower seat 178. Seat 178 is disposed between sleeve 144 and housing 132. Seat 178 is substantially fixably positioned relative to housing 132 due to the interaction between upper shoulder 180 of seat 178 and lower shoulder 143 of housing 132. Seat 178 is axially moveable relative to sleeve 144. Seat 178 includes an upper sealing surface 182 and an axially extending and internally inclined lip 184.

Lip 184 acts to prevent, or at least greatly reduce, erosion of sealing surface 182 as well as erosion of sleeve 144. Sealing surface 182 of seat 178 is cooperatively shaped to sealingly engage sealing surface 176 of seat 168, and, in the configuration of flow regulating device 130 shown in FIGS. 6A–6B, sealing surface 182 is contacting and sealingly engaging sealing surface 176. Together, seat 168 and seat 178 form a trim set such as that described above.

Flow regulating device 130 has a packing stack 186 that is disposed between sleeve 144 and upper connector 134. Flow regulating device 130 also has packing stack 188 that is disposed between seat 178 and housing 132. Supporting packing stack 186 within flow regulating device 130 is a bearing ring 190. An axially extending generally tubular collet extends downwardly from bearing ring 190. The collet has a plurality of circumferentially distributed collet fingers representatively illustrated by collet finger 192. Each collet finger has a radially extended interior region that is representatively illustrated as region 194 on collet finger 192. Flow regulating device 130 has an axially extending generally tubular biasing device 196 that is axially disposed between lower connector 136 and seat 178 to bias seat 178 toward seat 168.

In operation, flow regulating device 130 has four principal operating configurations. Specifically, flow regulating device 130 has a fully closed, fully sealed configuration, a fully closed, unsealed configuration, a partially opened configuration and a fully open configuration. Referring to FIGS. 6A–6B, flow regulating device 130 is representatively illustrated in a fully closed, fully sealed configuration in which sealing surface 176 of seat 168 is in sealing engagement with sealing surface 182 of seat 180 and seal elements 164, 166 straddle the location of the sealing engagement. Fluid is, thus, prevented from flowing through openings 146, 148, 150.

Figure 7B:
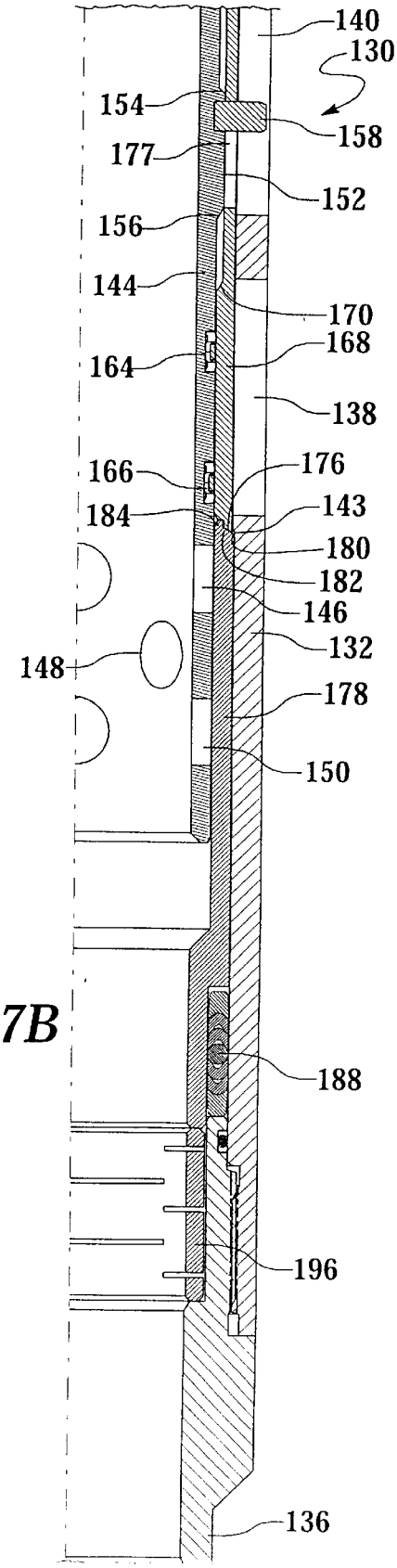

Referring next to FIGS. 7A–7B, flow regulating device 130 is representatively illustrated in a fully closed, unsealed configuration in which sealing surface 176 of seat 168 is in sealing engagement with sealing surface 182 of seat 180 but seal elements 164, 166 no longer straddle the location of the sealing engagement. In the illustrated embodiment, hydraulic fluid enters the bottom of hydraulic chamber 112 from hydraulic communication port 124 to upwardly shift sleeve 144 relative to seat 168, seat 178 and housing 132. In this configuration of flow control device 130, the sealing engagement of sealing surface 176 of seat 168 with sealing surface 182 of seat 180 substantially prevents fluid flow through openings 146, 148, 150. It is to be understood, however, that it is not necessary and somewhat unlikely that the sealing engagement of sealing surface 176 of seat 168 with sealing surface 182 of seat 180 completely prevents fluid communication between the area external to flow regulating device 130 and the flow passageway within flow regulating device 130 through openings 146, 148, 150.

As can be seen in comparing the configuration of flow regulating device 130 in FIGS. 6A–6B with the configuration of flow regulating device 130 in FIGS. 7A–7B, as sleeve 144 upwardly shifts relative to seat 168, seat 178 and housing 132, lug 158 travels upwardly within slot 140 of housing 132. In addition, lug 158 travels upwardly within slot 177 of seat 168. Also, as best seen in FIGS. 7A–7B, when lug 158 reaches its point of maximum upward travel within slot 177, thus defining the maximum upward travel of sleeve 144 relative to seat 168, the lower shoulder of radially extended exterior region 160 is nearing the top of collet finger head 174. Once radially extended exterior region 160 clears the top of collet finger head 174, collet finger head 174 may radially inwardly shift out of radially reduced interior region 142 of housing 132. Further upward travel of sleeve 144 will thereafter carry seat 168 upwardly due to the contact between lug 158 and the top of slot 177.

Figure 8A:
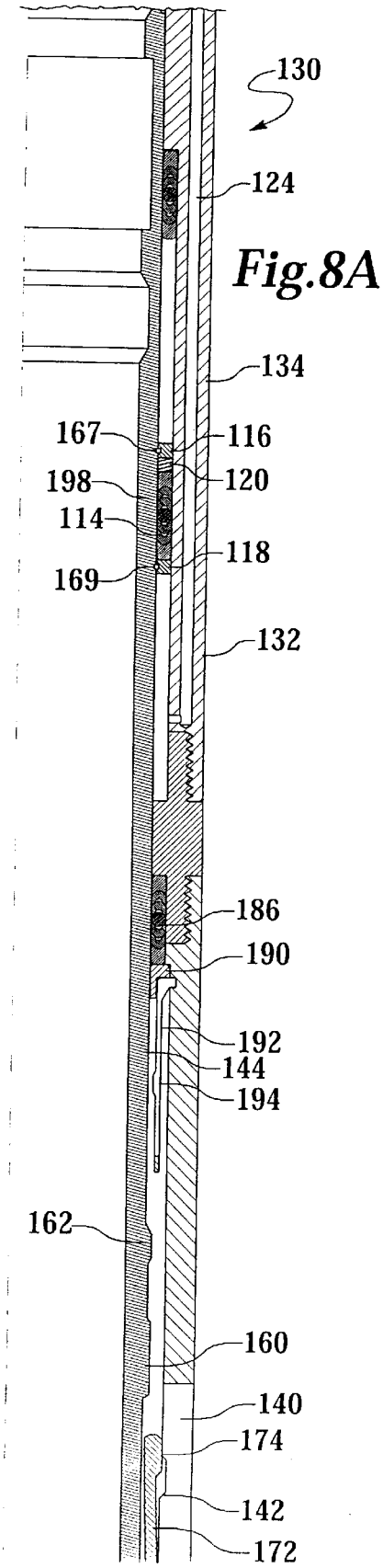
FIGS. 8A–8B are quarter sectional views of seccessive axial sections of a flow control device of the present invention depicted in its partially opened position.
Figure 8B:
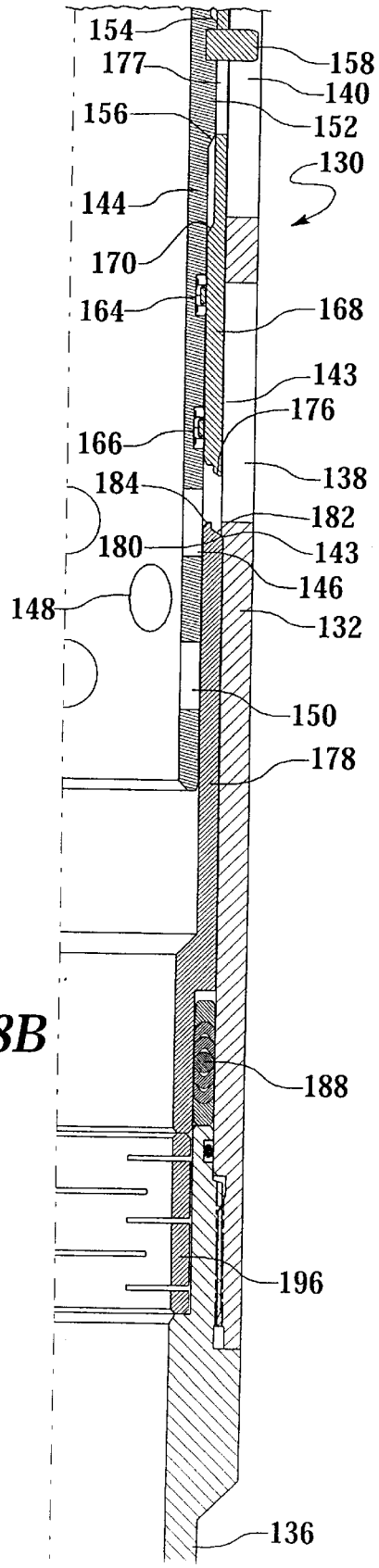

Referring additionally now to FIGS. 8A–8B, flow regulating device 130 is representatively illustrated in a partially open configuration in which openings 146 are partially exposed to direct fluid flow between the exterior of flow regulating device 130 and the fluid passage within flow regulating device 130 through openings 138 of housing 132. In this configuration, hydraulic fluid has shifted sleeve 144 and seat 168 relative to seat 178 and housing 132, thus permitting fluid flow through the exposed portion of openings 146 of sleeve 144. Additional upward or downward movement of sleeve 144 relative to seat 178 using hydraulic fluid pressure within hydraulic chamber 112 allows for precise control of the flowrate of fluid through flow regulating device 130 by increasing or decreasing the separation between seat 168 and seat 178 which is monitored using magnetic positioning sensor 120. Specifically, hydraulic fluid may enter the top of hydraulic chamber 112 from hydraulic communication port 110, as best seen in FIG. 6A, to downwardly shift sleeve 144.

Figure 9A:
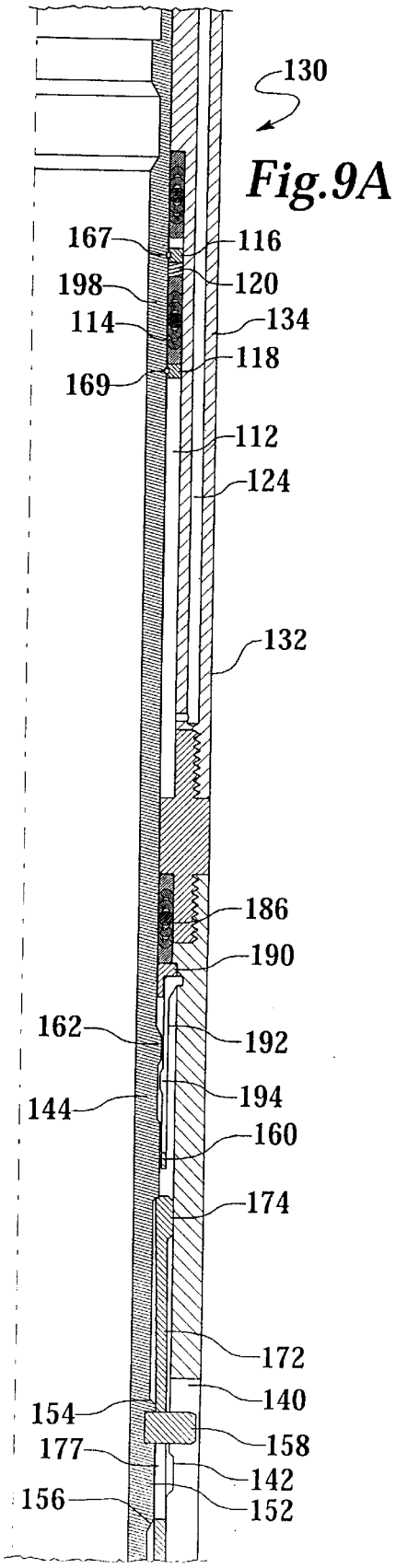
FIGS. 9A–9B are quarter sectional views of seccessive axial sections of a flow control device of the present invention depicted in its fully opened position.
Figure 9B:
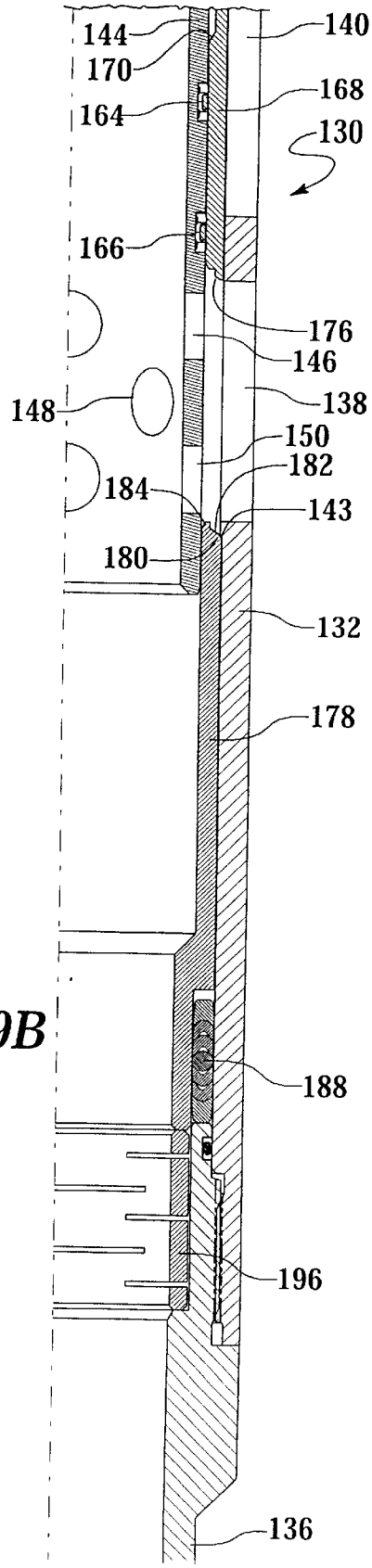

Referring now to FIGS. 9A–9B, flow regulating device 130 is representatively illustrated in a fully open configuration in which seat 178 has completely uncovered openings 146, 148, 150. Fluid is, thus, permitted to flow unobstructed through openings 146, 148, 150 and into the fluid passage of flow regulating device 130. In this configuration, radially extended exterior region 162 of sleeve 144 has moved across radially extended interior region 194 of collet 192 which, along with hydraulic fluid in the lower portion of hydraulic chamber 112, prevent downward movement of sleeve 144 relative to housing 132 until such downward movement is desired.

To return flow regulating device 130 to one of the prior configurations, hydraulic fluid enters the upper section of hydraulic chamber 112 from hydraulic communication port 110 to downwardly shift sleeve 144 and seat 168 relative to seat 178 and housing 132. Initially, sleeve 144 and seat 168 move together as the lower shoulder of radially extended exterior region 160 of sleeve 144 acts on the upper surface of collet finger head 174. Seat 168 travels downwardly until sealing surface 176 contacts sealing surface 182 and collet finger head 174 reaches radially reduced interior region 142. Further downward shifting of sleeve 144 results in relative movement between sleeve 144 and seat 168 as lugs 158 slide within slots 177. Such downward relative movement may continue until shoulder 156 contacts shoulder 170. Thereafter, further downward movement of sleeve 144 downwardly urges seat 178 which is upwardly biased by biasing device 196 to increase the force between sealing surfaces 176, 182 to thereby improve their sealing capability.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A flow regulating apparatus comprising:

a generally tubular outer housing having a housing port formed through a sidewall portion thereof;

a first seat disposed within the housing, the first seat having a first sealing surface;

a second seat slidably disposed within the housing, the second seat having a second sealing surface, the first and second sealing surfaces being sealingly engageable to substantially prevent fluid flow therebetween;

a sleeve slidably disposed within the first and second seats, the sleeve having a flow passage extending generally axially therethrough, the sleeve having a sleeve port formed through a sidewall portion thereof, the sleeve being positionable relative to the first seat to variably regulate fluid flow through the sleeve port, the sleeve having first and second positions relative to the second seat; and a seal disposed on the sleeve such that when the sleeve is in the first position, the seal is disposed between the sleeve and the first seat, thereby preventing fluid flow through the sleeve port and when the sleeve is in the second position, the seal is disposed between the sleeve and the second seat, thereby not preventing fluid flow through the sleeve port.

2. The apparatus as recited in claim 1 wherein the first seat has a lip extending outwardly therefrom, the lip being variably positionable relative to the sleeve port.

3. The apparatus as recited in claim 2 wherein the lip is configured to inhibit erosion of the first seat when fluid flow is regulated through the sleeve port by the first seat.

4. The apparatus as recited in claim 2 wherein the lip is configured to inhibit erosion of the sleeve when fluid flow is regulated through the sleeve port by the first seat.

5. The apparatus as recited in claim 1 further comprising a biasing device that biases the first seat toward the second seat to enhance the sealing engagement between the first and second sealing surfaces.

6. The apparatus as recited in claim 1 wherein the first and second sealing surfaces form a metal-to-metal seal therebetween.

7. The apparatus as recited in claim 1 wherein the housing includes a first engagement surface and the first seat includes a second engagement surface, and wherein contact between the first and second engagement surfaces prevents relative displacement between the first seat and the housing.

8. The apparatus as recited in claim 1 wherein the seal further comprises an elastomeric seal.

9. The apparatus as recited in claim 1 wherein the sleeve is further variably positionable in an infinite number of positions relative to the first seat to regulate fluid flow through the sleeve port.

10. A downhole flow control apparatus comprising:

a generally tubular sleeve having a flow passage extending generally axially therethrough, the sleeve having a sleeve port formed through a sidewall portion thereof, the sleeve having a seal disposed thereon; and first and second seats slidably disposed relative to the sleeve, the first seat having a first sealing surface, the second seat having a second sealing surface, the first and second sealing surfaces being sealingly engageable to substantially prevent fluid flow therebetween, the first seat having a first position relative to the sleeve wherein the seal is disposed between the sleeve and the first seat, thereby preventing fluid flow through the sleeve port, a second position wherein the seal is disposed between the sleeve and the second seat, thereby substantially preventing fluid flow through the sleeve port, a third position wherein fluid flow through the sleeve port is partially obstructed and a fourth position wherein fluid flow is permitted through the sleeve port.

11. The apparatus as recited in claim 10 wherein the first seat has a lip extending outwardly therefrom, the lip being variably positionable relative to the sleeve port.

12. The apparatus as recited in claim 11 wherein the lip is configured to inhibit erosion of the first seat when the first seat is in the third position.

13. The apparatus as recited in claim 11 wherein the lip is configured to inhibit erosion of the sleeve when the first seat is in the third position.

14. The apparatus as recited in claim 10 further comprising a biasing device that biases the first seat toward the second seat to enhance the sealing engagement between the first and second sealing surfaces.

15. The apparatus as recited in claim 10 wherein the first and second sealing surfaces form a metal-to-metal seal therebetween.

16. The apparatus as recited in claim 10 further comprising an outer housing disposed at least partially around the first and second seats and the sleeve, the outer housing having a housing port formed through a sidewall portion thereof.

17. The apparatus as recited in claim 16 wherein the housing includes a first engagement surface and the first seat includes a second engagement surface, and wherein contact between the first and second engagement surfaces prevents relative displacement between the first seat and the housing.

18. The apparatus as recited in claim 10 wherein the seal further comprises an elastomeric seal.

19. The apparatus as recited in claim 10 wherein the sleeve is further positionable in an infinite number of positions between the second and fourth positions.

20. A method of regulating fluid flow through a downhole tubing string comprising the steps of:

providing a generally tubular outer housing having a housing port formed through a sidewall portion thereof;

disposing a first seat within the housing, the first seat having a first sealing surface;

slidably disposing a second seat within the housing, the second seat having a second sealing surface, the first and second sealing surfaces being sealingly engageable to substantially prevent fluid flow therebetween;

operating a sleeve between first and second positions relative to the second seat such that, in the first position, a seal is disposed between the sleeve and the first seat, thereby preventing fluid flow through a sleeve port with the seal and such that, in the second position, the seal is disposed between the sleeve and the second seat, thereby not preventing fluid flow through the sleeve port with the seal; and variably positioning the sleeve relative to the first seat to regulate fluid flow through the sleeve port.

21. The method as recited in claim 20 further comprising the step of inhibiting erosion of the first seat when fluid flow is regulated through the sleeve port by outwardly extending a lip from the first seat.

22. The method as recited in claim 20 further comprising the step of inhibiting erosion of the sleeve when fluid flow is regulated through the sleeve port by outwardly extending a lip from the first seat.

23. The method as recited in claim 20 further comprising biasing the first seat toward the second seat to enhance the sealing engagement between the first and second sealing surfaces.

24. The method as recited in claim 20 further comprising the step of forming a metal-to-metal seal between the first and second sealing surfaces.

25. The method as recited in claim 20 further comprising the step of preventing relative displacement between the first seat and the housing by contacting a first engagement surface of the housing with a second engagement surface of the first seat.

26. The method as recited in claim 20 wherein the seal further comprises an elastomeric seal.

27. The method as recited in claim 20 wherein the step of variably positioning the sleeve relative to the first seat further comprises infinitely varying the position of the sleeve relative to the first seat to regulate fluid flow through the sleeve port.

28. The method as recited in claim 20 wherein the step of operating a sleeve between first and second positions relative to the second seat and variably positioning the sleeve relative to the first seat further comprise mechanically shifting the sleeve.

29. The method as recited in claim 20 wherein the step of operating a sleeve between first and second positions relative to the second seat and variably positioning the sleeve relative to the first seat further comprise hydraulically shifting the sleeve.

30. A method of regulating fluid flow through a downhole tubing string comprising the steps:

providing a generally tubular sleeve having a flow passage extending generally axially therethrough and a sleeve port formed through a sidewall portion thereof;

slidably positioning first and second seats relative to the sleeve, the first seat having a first sealing surface, the second seat having a second sealing surface, the first and second sealing surfaces being sealingly engageable to substantially prevent fluid flow therebetween; and positioning the first seat in four positions relative to the sleeve, in the first position, a seal is disposed between the sleeve and the first seat, thereby preventing fluid flow through the sleeve port with the seal, in the second position, the seal is disposed between the sleeve and the second seat, thereby not preventing fluid flow through the sleeve port with the seal, in the third position, fluid flow through the sleeve port is partially obstructed by the first seat and, in the fourth position, fluid flow is permitted through the sleeve port.

31. The method as recited in claim 30 further comprising the step of inhibiting erosion of the first seat when the first seat is in the third position by outwardly extending a lip from the first seat.

32. The method as recited in claim 30 further comprising the step of inhibiting erosion of the sleeve when the first seat is in the third position by outwardly extending a lip from the first seat.

33. The method as recited in claim 30 further comprising biasing the first seat toward the second seat to enhance the sealing engagement between the first and second sealing surfaces.

34. The method as recited in claim 30 further comprising the step of forming a metal-to-metal seal between the first and second sealing surfaces.

35. The method as recited in claim 30 further comprising the step of disposing an outer housing at least partially around the first and second seats and the sleeve, the outer housing having a housing port formed through a sidewall portion thereof.

36. The method as recited in claim 35 further comprising the step of preventing relative displacement between the first seat and the housing by contacting a first engagement surface of the housing with a second engagement surface of the first seat.

37. The method as recited in claim 30 wherein the seal further comprises an elastomeric seal.

38. The method as recited in claim 30 further comprising the step of infinitely varying the position of the sleeve relative to the first seat between the second and fourth positions.

39. The method as recited in claim 30 wherein the step of positioning the first seat in four position relative to the sleeve further comprises mechanically shifting the sleeve.

40. The method as recited in claim 30 wherein the step of positioning the first seat in four position relative to the sleeve further comprises hydraulically shifting the sleeve.

* * * * *